US006677808B1

(12) United States Patent
Sean et al.

(10) Patent No.: US 6,677,808 B1
(45) Date of Patent: Jan. 13, 2004

(54) CMOS ADJUSTABLE BANDGAP REFERENCE WITH LOW POWER AND LOW VOLTAGE PERFORMANCE

(75) Inventors: S. Chen Sean, Sunnyvale, CA (US); Don R. Sauer, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/222,131

(22) Filed: Aug. 16, 2002

(51) Int. Cl.[7] ..... G05F 1/10
(52) U.S. Cl. ..... 327/539; 327/542; 323/313
(58) Field of Search ..... 327/539, 538, 327/540, 541, 542, 543; 323/313

(56) References Cited

U.S. PATENT DOCUMENTS

| | | | | |
|---|---|---|---|---|
| 4,317,054 A | | 2/1982 | Caruso et al. | 307/297 |
| 4,349,778 A | | 9/1982 | Davis | 323/314 |
| 4,396,883 A | | 8/1983 | Holloway et al. | 323/313 |
| 4,506,208 A | | 3/1985 | Nagano | 323/314 |
| 5,434,533 A | | 7/1995 | Furutani | 327/538 |
| 5,570,008 A | | 10/1996 | Goetz | 323/315 |
| 5,587,655 A | | 12/1996 | Oyabe et al. | 323/312 |
| 6,046,578 A | | 4/2000 | Feldtkeller | 323/314 |
| 6,242,897 B1 | * | 6/2001 | Savage et al. | 323/313 |
| 6,362,612 B1 | * | 3/2002 | Harris | 323/312 |
| 6,380,723 B1 | | 4/2002 | Sauer | 323/315 |
| 6,407,622 B1 | * | 6/2002 | Opris | 327/539 |
| 6,529,066 B1 | * | 3/2003 | Guenot et al. | 327/539 |
| 6,549,065 B2 | * | 4/2003 | Opris | 327/539 |
| 6,563,371 B2 | * | 5/2003 | Buckley et al. | 327/539 |
| 2002/0093325 A1 | * | 7/2002 | Ju | 323/316 |

* cited by examiner

*Primary Examiner*—Terry D. Cunningham
(74) *Attorney, Agent, or Firm*—Brett A. Hertzberg; Merchant & Gould P.C.

(57) ABSTRACT

A voltage reference circuit is arranged in a CMOS process based technology to provide a configurable voltage reference. The voltage reference includes bipolar transistors that are implemented as parasitic devices in the CMOS process. Two of the bipolar transistors are configured to generate a ΔVbe signal in the voltage reference circuit. An error amplifier cooperates with the two bipolar transistors via a control signal such that the control signal is related to ΔVbe/R. A first current source is coupled to another bipolar device, which is parallel connected to a resistor divider. The output of the resistor divider provides a divided reference signal that is related to the Vbe of the other bipolar device. Another resistor is coupled between a second current source and the output of the resistor divider such that an adjustable/temperature compensated reference signal is provided.

15 Claims, 3 Drawing Sheets

CM OS ADJUSTABLE BANDGAP REFERENCE WITH LOW POWER AND LOW VOLTAGE PERFORMANCE

FIELD OF THE INVENTION

The present invention is related to a method and system for generating a reference voltage. More particularly, the present invention is related to a CMOS bandgap reference voltage circuit that operates on low-voltage power supplies with low power consumption.

BACKGROUND OF THE INVENTION

Bandgap voltage references are used as voltage references in electronic systems. The energy bandgap of Silicon is on the order of 1.2 V, and is independent from temperature and power supply variations. Bipolar transistors have a negative temperature drift with respect to their base-emitter voltage (Vbe decreases as operating temperature increases on the order of −2 mV/deg C.). However, the thermal voltage of a bipolar transistor has a positive temperature drift (Vt=kT/q, thus Vt increases as temperature increases). The positive temperature drift in the thermal voltage (Vt) may be arranged to compensate the negative temperature drift in the bipolar transistor's base-emitter voltage. Bandgap reference circuits use the inherent characteristics of bipolar transistors to compensate for temperature effects and provide a stable operating voltage over various power supply and temperature ranges.

One example bandgap reference circuit includes two bipolar transistors that are arranged with a common base. Two resistors are series connected between the emitter of the first bipolar transistor and a common ground. The emitter of second bipolar transistor is connected to the common point between the two resistors. The two bipolar transistors are arranged to provide a ten-to-one (10:1) current density difference with respect to one another. The ten-to-one current density results in a 60 mV difference between the base-emitter voltages of two bipolar transistors ($\Delta Vbe = Vt*\ln(I1/I2) = 26\ mV*\ln(10) = 60\ mV$, at room temperature). The 60 mV difference appears across the first resistor. The voltage between the base of the bipolar transistors and the ground terminal provides a voltage reference (VREF) that is roughly given as VREF=Vbe+X*Vt, where X is a constant that is used to scale the temperature correction factor. The temperature correction factor (X) is adjusted by the ratio of the resistors. Typical temperature corrected reference voltages of 1.25 V are achieved by this configuration.

SUMMARY OF THE INVENTION

The present invention is related to a voltage reference that operates from a low power supply voltage. More specifically the present invention is directed to voltage references that operate in the power supply range from approximately 1.2 volts to 6 volts. The bandgap reference is implemented in a CMOS process such that smaller die sizes and power consumption may be decreased.

Briefly stated, a voltage reference circuit is arranged in a CMOS process based technology to provide a configurable voltage reference. The voltage reference includes bipolar transistors that are implemented as parasitic devices in the CMOS process. Two of the bipolar transistors are configured to generate a ΔVbe signal in the voltage reference circuit. An error amplifier cooperates with the two bipolar transistors via a control signal such that the control signal is related to ΔVbe/R. A first current source is coupled to another bipolar device, which is parallel connected to a resistor divider. The output of the resistor divider provides a divided reference signal that is related to the Vbe of the other bipolar device. Another resistor is coupled between a second current source and the output of the resistor divider such that an adjustable/temperature compensated reference signal is provided.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

The present invention relates to voltage references that operate from a low power supply voltage. Typically, it is necessary for the power supply voltage to be higher than the reference voltage. In some applications, such as portable devices or other devices that operate on reduced power supply levels, the maximum power supply voltage may be lower than 1.2 Volts. An exemplary implementation of the present invention is a CMOS based temperature compensated reference circuit that operates on power supply levels that are in the range from 1.2 Volts to 6 Volts. Additional CMOS technologies may have minimum power supply voltage requirements that are higher or lower than those used for the above-described example. Namely, typical CMOS circuits have power supply requirements that are determined based on the minimum threshold voltages, and saturation voltages that are required for the specific circuit. However, it is understood and appreciated that the concepts discussed in reference to the present invention may be adapted for use in reference circuits that have other power supply voltage levels.

The present invention is implemented in a CMOS process such that the overall die area that is required for an integrated circuit implementation is smaller than that employed in other technologies (e.g., BiCMOS). Also, a pure CMOS implementation ensures that overall current consumption is reduced compared to other technologies. An exemplary circuit that is arranged according to the present invention has been implemented in a pure CMOS process, yielding a 1 mV variation in reference voltage with power supplies from 1.2 V to 6 V, and temperatures from −45 deg C. to 95 deg C.

Bandgap Reference Circuit

Figure 1:
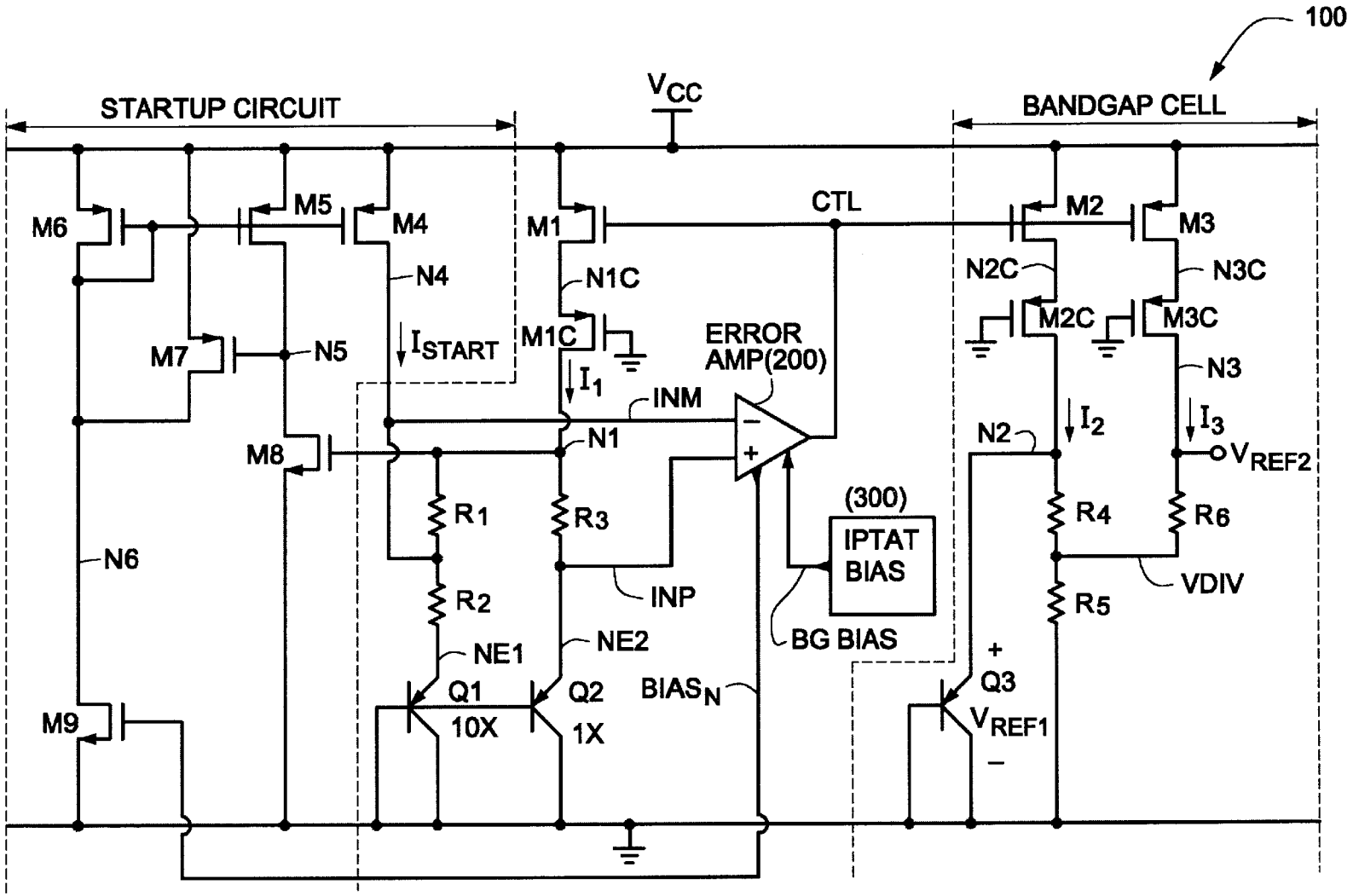
FIG. 1 is a schematic diagram of a CMOS Bandgap reference that is arranged in accordance with the present invention.

FIG. 1 is a schematic diagram of an exemplary reference circuit (100) that is arranged in accordance with the present invention. Reference circuit 100 includes MOS transistors M1–M9, M1C–M3C, PNP transistors Q1–Q3, resistors R1–R6, IPTAT bias circuit 300, and error amplifier 200. The PNP transistors (Q1–Q3) are implemented as vertical devices in the CMOS process, without any special processing requirements. An exemplary PNP transistor is constructed in a CMOS process as a vertical device that includes: p-type substrate material, n-type well material, and p-type diffusions that is placed in the n-type well.

Transistor M1 includes a source that is connected to VCC, a gate that is connected to CTL, and a drain that is connected to node N1C. Transistor M1C includes a source that is connected to node N1C, a gate that is connected to ground, and a drain that is connected to node N1. Transistor M2 includes a source that is connected to VCC, a gate that is connected to CTL, and a drain that is connected to node N2C. Transistor M2C includes a source that is connected to node N2C, a gate that is connected to ground, and a drain that is connected to node N2. Transistor M3 includes a source that is connected to VCC, a gate that is connected to CTL, and a drain that is connected to node N3C. Transistor M3C includes a source that is connected to node N3C, a gate that is connected to ground, and a drain that is connected to node N3. Resistor R1 is connected between nodes N1 and N4. Resistor R2 is connected between nodes N4 and NE1. Resistor R3 is connected between nodes N1 and NE2. Resistor R4 is connected between node N2 and VDIV. Resistor R5 is connected between VDIV and ground. Resistor R6 is connected between VREF2 and VDIV. PNP transistor Q1 includes an emitter that is connected to node NE1, and a base and collector that are connected to ground. PNP transistor Q2 includes an emitter that is connected to node NE2, and a base and collector that are connected to ground. PNP transistor Q3 includes an emitter that is connected to node N2, and a base and collector that are connected to ground. Error amplifier 200 includes a non-inverting input (INP) that is connected to node NE2, an inverting input (INM) that is connected to node N4, an output that is connected to CTL, a bias output signal that is provided to BIASN, and a bias input that is coupled to BGBIAS. IPTAT bias 300 provides a bias signal to BGBIAS.

Transistors M1–M3, M1C–M3D, Q1–Q3, error amplifier 200, IPTAT bias circuit 300, and resistors R1–R5 comprises a CMOS bandgap reference that is arranged in accordance with the present invention. IPTAT bias circuit 300 provides bias signal BGBIAS to error amplifier 200 that is proportional to absolute temperature. The bias signal cooperates with error amplifier 200 such that transistor M1 (which is controlled by error amplifier 200 at node CTL) provides a current that is proportional to ΔVbe/R. Transistors M1C is are arranged to operate as cascode transistors for the cascode current source that is formed by transistor M1 and M1C such that a current I1 is provided at node N1. Current I1 is driven into the parallel combination of R1, R2, Q1 and R3, Q2. At steady-state operation, the voltages at node NE2 and N4 are approximately the same (ignoring any offsets from the error amplifier). Since transistors Q1 and Q2 have different effective emitter areas (10 to 1), the base-emitter voltages will not match exactly. The difference in the base-emitter voltages is provided across resistor R2 such that the current in resistor R2 corresponds to ΔVbe/R2, where ΔVbe is the difference in emitter voltages of transistors Q1 and Q2.

The CMOS bandgap reference includes a bandgap cell that comprises transistors M2, M3, M2C, M3C, resistors R4–R6, and transistor Q3. Transistors M2 and M2C form a cascode current source that provides current I2 to node N2 in response to the control signal (CTL). Transistors M3 and M3C form another cascode current source that provides current I3 to node N3 in response to the control signal (CTL). Similar to current I1, the control signal is provided by the error amplifier such that currents I2 and I3 are proportional to ΔVbe/R. Transistor Q3 will have an associated forward bias voltage that serves as a reference voltage (VREF1) at node N2. In one example, the forward bias voltage across transistor Q3 is on the order of 600 mV, and resistors R4 and R5 form a voltage divider that divides the forward bias voltage (VREF1) such that VDIV=VREF1/(1+(R4/R5)). For example, when R4 and R5 are of equal values, and the forward bias voltage is 600 mV, the potential (VDIV) will be roughly 300 mV (assuming I3=0). When I3 is nonzero, the output of the voltage divider (VDIV) formed by resistors R4 and R5 increases. The contribution to from current source I3, results in another reference voltage (VREF2) at node N3, where VREF2=VDIV+I3*R6. Since I3 is proportional to ΔVbe/R, the other reference voltage (VREF2) is given by VREF2=[VREF1/(1+(R4/R5))]+[X*(ΔVbe/R)]*R6, where X is a scaling factor for current I3. When R4=R5, VREF2=(VREF1/2)+(K*ΔVbe), where K is a constant that is determined by X, R6 and R, such that a temperature compensation effect is provided to VREF2.

The temperature coefficient of VREF2 is determined by the temperature coefficient of the base-emitter voltage of Q1, and the temperature coefficient of ΔVbe. Since the temperature coefficient of VBE is a negative number, and the temperature coefficient of ΔVbe is a positive temperature coefficient, then K can be adjusted such that the overall temperature coefficient of VREF2 is zero at a predetermined temperature level.

Transistors M2 and M3 are matched to one-another according to a scaling coefficient such that the relative sizes of transistors M2 and M3 contribute to constant K. Also, resistor R6 similarly contributes to the constant K. By adjusting the ration of R4/R5 and by adjusting the constant K, the voltage associated with VREF2 can range to any desired voltage. The voltage range for VREF2 is limited by the power supply voltage and the operating range of the current source transistors (M2–M3, M2C–M3C). For example, the saturation voltage of transistors M2 and M3 may limit the range for currents I2 and I3.

The CMOS bandgap reference includes a startup circuit that includes transistors M4–M9. Transistor M4 includes a source that is connected to VCC, a gate that is connected to node N6, and a drain that is connected to node N4. Transistor M5 includes a source that is connected to VCC, a gate that is connected to node N6, and a drain that is connected to node N5. Transistor M6 includes a source that is connected to VCC, a gate and a drain that are connected to node N6. Transistor M7 has a source that is connected to VCC, a gate that is connected to node N5, and a drain that is connected to node N6. Transistor M8 includes a source that is connected to ground, a gate that is connected to node N1, and a drain that is connected to node N5. Transistor M9 includes a source that is connected to ground, a gate that is connected to BIASN, and a drain that is connected to node N6.

The exemplary startup circuit that is arranged to initialize the CMOS bandgap circuit to an appropriate operating point during power-up. The startup circuit is enabled when transistor M9 is active, such that transistor M6 operates as a forward biased diode. However, transistor M9 is inactive until the error amplifier is biased into a valid operating range, as indicated by signal BIASN. By maintaining transistor M9 inactive until the error amplifier is properly biased, then a smooth start-up of the bandgap circuit 100 is possible. Transistors M4 and M5 operate as current sources in a current mirror that is formed with transistor M6. M4 is activated by transistor M6 such that a startup current (Istart) is provided to node N4. The startup current continues until the potential at node N1 is sufficient to activate transistor M8. Once transistor M8 is activated, the gate of transistor M7 is pulled low (towards ground) and node N6 is pulled up to VCC such that transistors M4–M6 are deactivated.

The startup circuit that is illustrated in FIG. 1 provides for a smooth initialization of bandgap circuit 100. However, the startup circuit may be replaced by another startup circuit, as may be necessary for a particular system design. In one example, a simple startup circuit may comprise a high value resistive device that is coupled between VCC and node N4 (alternatively node N1, NE1 or NE2). Another circuit such as a POR (power-on reset) circuit may be used to gate the startup circuit such that the startup circuit is disabled after the bandgap circuit is in proper operation.

Error amplifier 200 is biased by BGBIAS as shown in FIG. 1. By biasing the error amplifier with a PTAT (proportional to absolute temperature) current, higher order temperature effects are minimized so that the temperature coefficient that is associated with VREF2 is well controlled. However, the IPTAT bias circuit may be replaced with a simple biasing circuit (e.g., a resistor device that is in series with a diode device) when the higher order temperature effects do not detrimentally effect the overall temperature compensation of VREF2.

Error Amplifier

Figure 2:
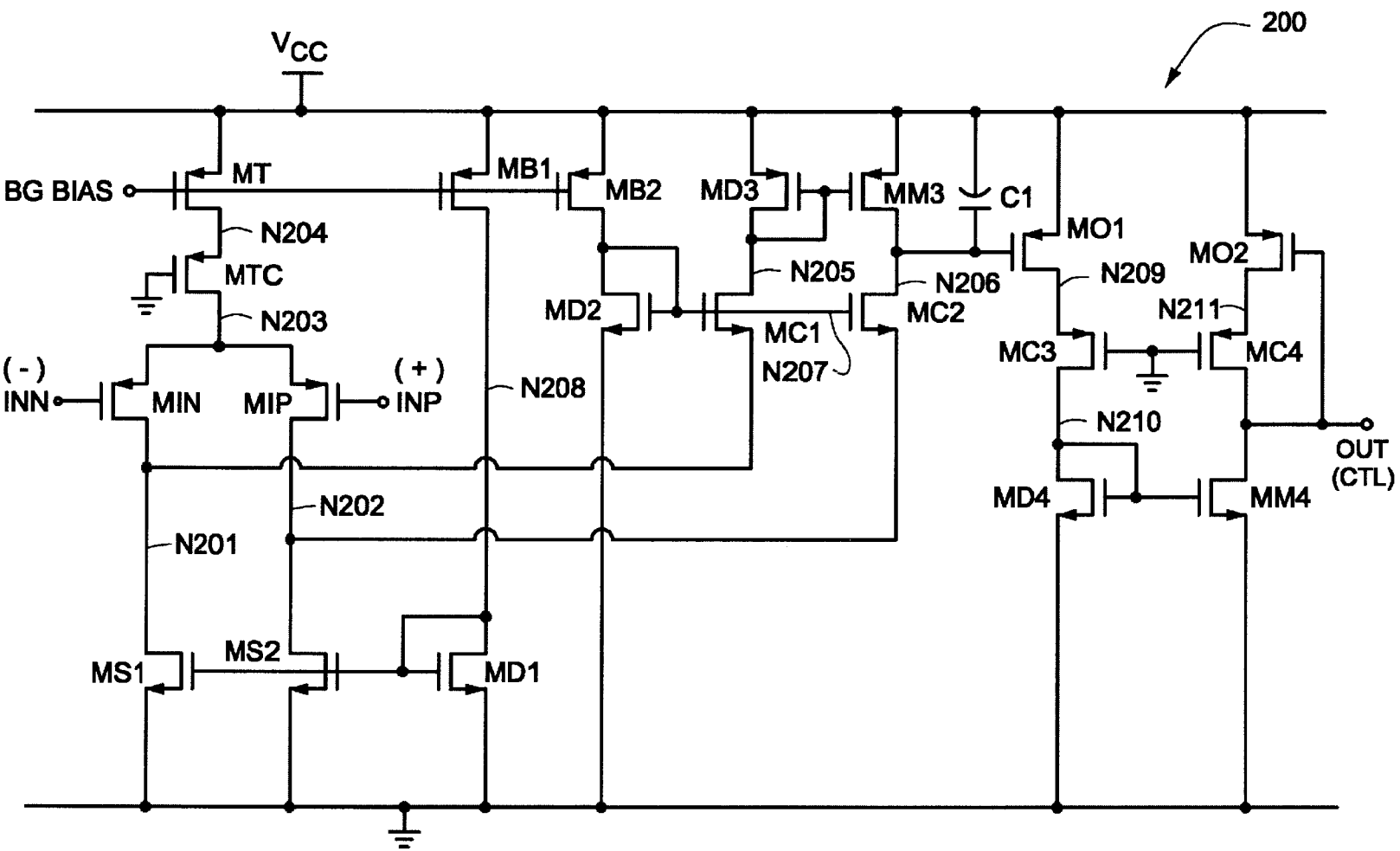
FIG. 2 is a schematic diagram of an error amplifier for the CMOS bandgap reference that is shown in FIG. 1, in accordance with the present invention.

FIG. 2 is a schematic diagram of an exemplary error amplifier (200) for the CMOS bandgap reference that is shown in FIG. 1, in accordance with the present invention. Error amplifier 200 includes MOS transistors MT, MTC, MIN, MIP, MS1, MS2, MD1–MD4, MB1–MB2, MC1–MC4, MM3–MM4, and capacitor C1.

Transistor MT includes a source that is connected to VCC, a gate that is connected to BGBIAS, and a drain that is connected to node N204. Transistor MTC includes a source that is connected to node N204, a gate that is connected to ground, and a drain that is connected to node N203. Transistor MIN includes a source that is connected to node N203, a gate that is connected to an inverting input (–, INN), and a drain that is connected to node N201. Transistor MIP includes a source that is connected to node N203, a gate that is connected to a non-inverting input (+, INP), and a drain that is connected to node N202. Transistor MS1 includes a source that is connected to ground, a gate that is connected to node N208, and a drain that is connected to node N201. Transistor MS2 includes a source that is connected to ground, a gate that is connected to node N208, and a drain that is connected to node N202. Transistor MD1 includes a source that is connected to ground, and a gate and drain that are connected to node N208. Transistor MB1 includes a source that is connected to VCC, a gate that is connected to BGBIAS, and a drain that is connected to node N208. Transistor MB2 includes a source that is connected to VCC, a gate that is connected to BGBIAS, and a drain that is connected to node N207. Transistor MD2 includes a source that is connected to ground, and a gate and drain that are connected to node N207. Transistor MC1 includes a source that is connected to node N201, a gate that is connected to node N207, and a drain that is connected to node N205. Transistor MC2 includes a source that is connected to node N202, a gate that is connected to node N207, and a drain that is connected to node N206. Transistor MD3 includes a source that is connected to VCC, and a gate and drain that are connected to node N205. Transistor MM3 includes a source that is connected to VCC, a gate that is connected to node N205, and a drain that is connected to node N206. Transistor MO1 includes a source that is connected to VCC, a gate that is connected to node N206, and a drain that is connected to node N209. Transistor MC3 includes a source that is connected to node N209, a gate that is connected to ground, and a drain that is connected to node N210. Transistor MD4 includes a source that is connected to ground, and a gate and drain that are connected to node N210. Transistor MM4 includes a source that is connected to ground, a gate that is connected to node N210, and a drain that is connected to OUT. Transistor MC4 includes a source that is connected to node N211, a gate that is connected to ground, and a drain that is connected to OUT (CTL). Transistor MO2 includes a source that is connected to VCC, a gate that is connected to OUT, and a drain that is connected to node N211. Capacitor C1 is connected between VCC and node N206.

The error amplifier is arranged as a folded cascode amplifier that is biased with a bias signal (BGBIAS) such that the currents provided by transistors MT, MB1, and MB2 are proportional to ΔVbe/R. The biasing of the error amplifier with ΔVbe/R currents will aid in reducing higher order temperature related effects in the overall system. However, the error amplifier may be biased with another bias signal as previously described above. Additionally, the error amplifier may be employed in another amplifier topology without departing from the spirit of the present invention.

MOS transistors MO1, MC3, MD4, MO2, MC4, and MM4 form a current mirror circuit that is arranged to provide scaling of the control output signal for other electronic circuits (e.g., the error amplifier). In another embodiment of the present invention, the current mirror circuit (formed by MOS transistors MO1, MC3, MD4, MO2, MC4, and MM4) is unnecessary and node N206 is configured to operate as the output node that provides the control output signal (CTL). In still another embodiment, other arrangements of current mirrors may be employed without departing from the spirit of the present invention.

IPTAT Bias

Figure 3:
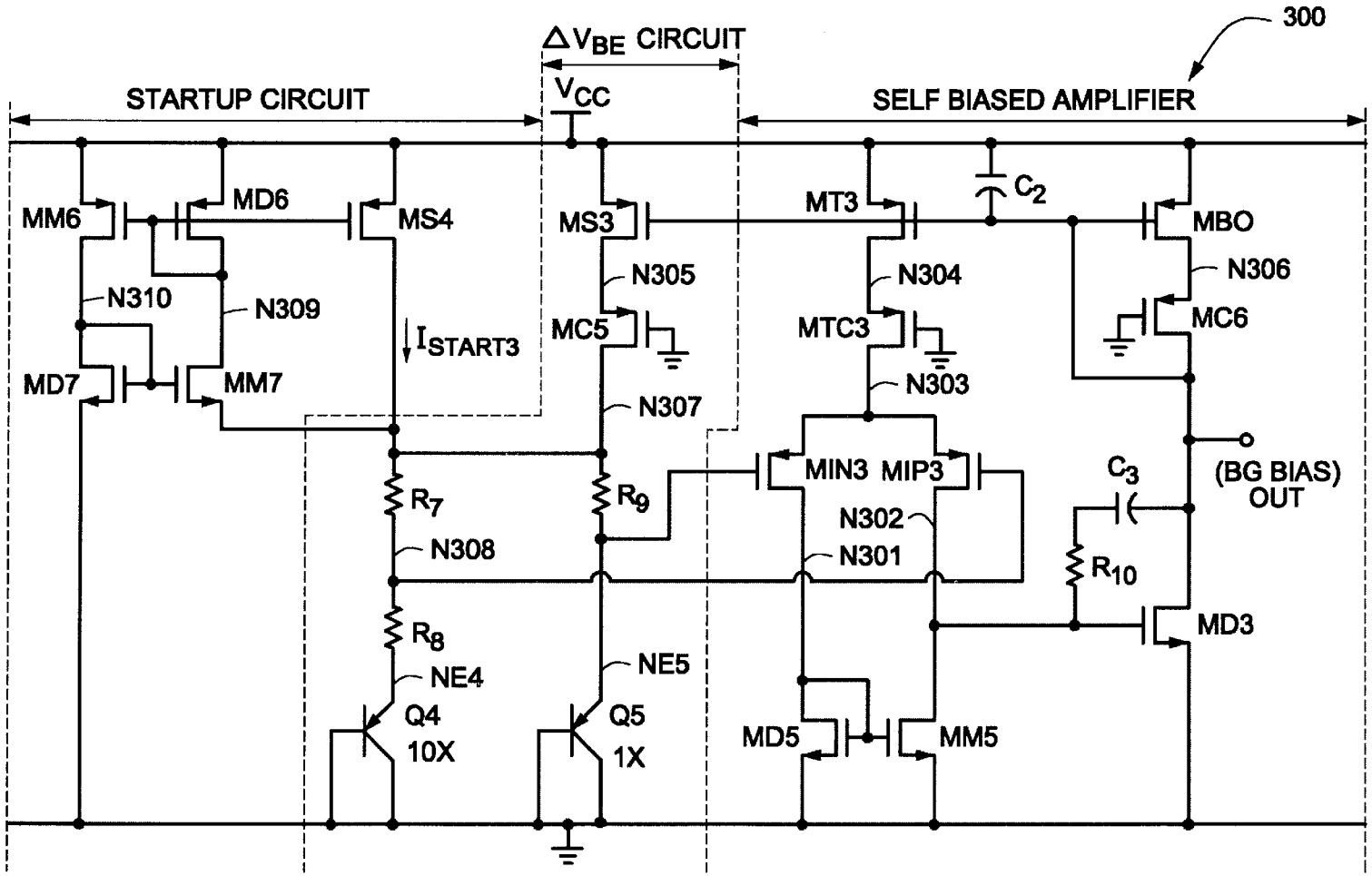
FIG. 3 is a schematic diagram of an IPTAT bias circuit that is used to bias the error amplifier that is shown in FIG. 1, in accordance with the present invention.

FIG. 3 is a schematic diagram of an IPTAT bias circuit that is used to bias the error amplifier that is shown in FIG. 1, in accordance with the present invention. The IPTAT Bias circuit includes a ΔVbe generator circuit, a self-biased amplifier circuit, and a startup circuit.

The ΔVbe generator circuit includes resistors R7–R9, PNP transistors Q4–Q5, and MOS transistors MS3 and MC5. PNP transistor Q4 includes a base and collector that are connected to ground, and an emitter that is connected to node NE4. PNP transistor Q5 includes a base and collector that are connected to ground, and an emitter that is connected to node NE5. Resistor R7 is connected between nodes N307 and N308. Resistor R8 is connected between nodes N308 and NE4. Resistor R9 is connected between nodes N307 and NE5. Transistor MS3 includes a source that is connected to VCC, a gate that is connected to BGBIAS (OUT), and a drain that is connected to node N305. Transistor MC5 includes a source that is connected to node N305, a gate that is connected to ground, and a drain that is connected to node N307.

The self-biased amplifier circuit includes transistors MIN3, MIP3, MT3, MTC3, MD5, MM5, MO3, MC6, MBO, resistor R10, and capacitors C2 and C3. Transistor MT3 includes a source that is connected to VCC, a gate that is connected to BGBIAS, and a drain that is connected to node N304. Transistor MTC3 includes a source that is connected to node N304, a gate that is connected to ground, and a drain that is connected to node N303. Transistor MIN3 includes a source that is connected to node N303, a gate that is connected to node NE5, and a drain that is connected to node N301. Transistor MIP3 includes a source that is connected to node N303, a gate that is connected to node N308 and a drain that is connected to node N302. Transistor MD5 includes a source that is connected to ground, and a gate and drain that are connected to node N301. Transistor MM5 includes a source that is connected to ground, a gate that is connected to node N301, and a drain that is connected to node N302. Transistor MO3 includes a source that is connected to ground, a gate that is connected to node N302, and a drain that is connected to BGBIAS. Transistor MBO includes a source that is connected to VCC, a gate that is connected to BGBIAS, and a drain that is connected to node N306. Transistor MC6 includes a source that is connected to node N306, a gate that is connected to ground, and a drain that is connected to BGBIAS. Resistor C2 is coupled between VCC and BGBIAS. Resistor R10 and capacitor C3 are series connected between node N302 and BGBIAS.

Transistors MIN3 and MIP3 are configured as a common source differential pair that is biased by a current source that is formed by transistors MT3 and MTC3. Transistors MD5 and MM5 are configured as a current mirror circuit. Transistor MO3 is configured as part of an output stage in the self-biased amplifier. Resistor R10 and capacitor C3 are configured as a compensation network such that stable operation of the self-biased amplifier is achieved. Capacitor C2 is also configured as a filter network.

Transistors MC5, MTC3, and MC6 are cascode transistors for current source/mirror transistors MS3, MT3, and MBO, respectively. The cascode transistors increase the output impedance of the current source/mirror transistors. In another example, the cascode transistors may be biased at another potential, or merely eliminated as may be desired.

The startup circuit includes transistors MS4, MM6–MM7, and MD6–MD7. Transistor MS4 includes a source that is connected to VCC, a gate that is connected to node N309 and a drain that is connected to node N307. Transistor MM6 includes a source that is connected to VCC, a gate that is connected to node N309 and a drain that is connected to node N310. Transistor MD6 includes a source that is connected to VCC, and a gate and drain that are connected to node N309. Transistor MM7 includes a source that is connected to node N307, a gate that is connected to node N310, and a drain that is connected to node N309. Transistor MD7 includes a source that is connected to VCC, and a gate and drain that are connected to node N310.

In operation, the startup circuit provides a start-up current (Istart3) to node N307 during a power-up sequence. The start-up current is configured to initialize the self-biased amplifier and the ΔVbe circuit that is shown in FIG. 3. In one example, node N307 may initially be at ground, while nodes N310 and N309 are at VCC. When the power supply (VCC) increases above the threshold of transistor MD7, transistor MM7 will become active forming a conduction path between transistor MD6 and ground. Once transistor MD6 is active, transistor MS4 will also be active such that startup-current ISTART3 is driven into node N307. After the voltage at node N307 exceeds a predetermined amount (e.g., node N310 and node N307 are less than a threshold voltage apart), transistor MM7 will be deactivated, resulting in the deactivation of transistors MD6, MM6, and MS4. Another startup circuit may be employed in place of the startup circuit that is shown in FIG. 3 without departing from the spirit of the present invention.

As illustrated in FIG. 3, PNP transistor Q4 has an area that is ten times (10×) the area that is associated with transistor Q3. The PNP transistors are configured as diodes. Since transistors Q4 and Q5 have a common base connection, the base-emitter voltages of transistors Q4 and Q5 differ by an amount that is determined by resistors R7–R9 and the current flow through the resistors. The self-biased amplifier senses the emitter voltage of transistor Q5 at node NE5, the voltage of resistor R8 at node N308, and provides a feedback current through transistors MS3 and MC5. The feedback current is provided to transistors Q4 and Q5 via resistors R7–R9. At steady-state operation, the self-biased amplifier controls the feedback current such that the voltage at node NE5 and node N308 are equal. The emitter voltage of transistor Q4 will be lower than the emitter voltage of transistor Q5 due to the transistors differences in area. Thus, the difference in the base-emitter voltage (ΔVbe) of transistors Q4 and Q5 is provided across resistor R8. The current flow in transistors MS3, MC5, MBO, and MC5 is thus proportional to absolute temperature (IPTAT), and is determined by ΔVbe/R.

The PNP transistors that are illustrated in FIGS. 1–3 are vertical transistor structures that are formed in the substrate of a CMOS process. For example, a PNP transistor is formed in a CMOS process by placing p-type material in an n-type well, where the substrate material is p-type such that the well operates as a base, the p-type material operates as an emitter, and the p-type substrate material operates as a collector.

In light of the above description, it is understood and appreciated that the circuits shown in FIG. 1–FIG. 3 may be arranged to operate with NPN transistors instead of PNP transistors. When NPN transistors are employed, the entire system will be redesigned such that the p-type MOS transistors are replaced with n-type MOS transistors, and vice-versa. For example transistors M1, M2, and M3 would be replaced with n-type MOS transistors that are referenced to ground instead of VCC when transistors Q1–Q3 are replaced with NPN type transistors that are referenced to VCC. Additionally, it is understood and appreciated that the design may be further arranged to operate using other field effect transistor types including, but not limited to JFET transistors, GaAsFET transistors, and the like.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A CMOS process based voltage reference circuit that is arranged to provide a reference voltage with temperature effect compensation, comprising:

a first bipolar transistor that is configured as a diode, wherein the first bipolar transistor is a parasitic transistor in the CMOS process that includes an emitter that is coupled to a first emitter node;

a second bipolar transistor that is configured as a diode, wherein the first bipolar transistor is a parasitic transistor in the CMOS process that includes an emitter that is coupled to a second emitter node;

a third bipolar transistor that is configured as a diode, wherein the third bipolar transistor is a parasitic transistor in the CMOS process that includes an emitter that is coupled to a second node;

a first resistor that is coupled between a first node and a fourth node;

a second resistor that is coupled between the fourth node and the first emitter node;

a third resistor that is coupled to the first node and the second emitter node;

a fourth resistor that is coupled between the second node and divider node;

a fifth resistor that is coupled to the divider node such that the fourth and fifth resistors are coupled in parallel with the third bipolar transistor;

a sixth resistor that is coupled between a third node and the divider node;

a CMOS amplifier that includes an inverting input that is coupled to the fourth node, a non-inverting input that is coupled to the second emitter node, and an output that is coupled to a control node;

a first MOS current source that includes an output that is coupled to the first node, and an input that is coupled to the control node;

a second MOS current source that includes an output that is coupled to the second node, and an input that is coupled to the control node; and a third MOS current source that includes an output that is coupled to the third node, and an input that is coupled to the control node, wherein a reference voltage with temperature effect compensation is provided at the third node.

2. The CMOS process based voltage reference circuit of claim 1, wherein the first MOS current source includes a first p-type MOS transistor and a first p-type cascode MOS transistor, wherein the first p-type MOS transistor includes a source that is coupled to a power supply node, a gate that is coupled to the control node, and a drain that is coupled to the source of the first p-type cascode MOS transistor, and wherein the drain of the first p-type cascode MOS transistor is coupled to the first node.

3. The CMOS process based voltage reference circuit of claim 1, wherein the first MOS current source includes a first n-type MOS transistor and a first n-type cascode MOS transistor, wherein the first n-type MOS transistor includes a source that is coupled to a power supply node, a gate that is coupled to the control node, and a drain that is coupled to the source of the first n-type cascode MOS transistor, and wherein the drain of the first n-type cascode MOS transistor is coupled to the first node.

4. The CMOS process based voltage reference circuit of claim 1, further comprising a startup circuit that is configured to change the voltage associated with the fourth node during a power-up condition such that the voltage reference circuit is initialized during the power-up condition.

5. The CMOS process based voltage reference circuit of claim 4, wherein the startup circuit includes an output that is coupled to at least one of the first node, the fourth node, the first emitter node, and the second emitter node such that a start-up current is provided to the output during the power-up condition.

6. The CMOS process based voltage reference circuit of claim 4, wherein the startup circuit further comprises a fourth MOS transistor that is configured to provide the startup current to the fourth node during the power-up condition.

7. The CMOS process based voltage reference circuit of claim 6, the startup circuit further comprising:

a sixth MOS transistor that is configured to bias the fourth transistor when active;

a seventh MOS transistor that is configured to disable the sixth transistor when active such that the start-up current is disabled; and an eighth MOS transistor that is configured to activate the seventh transistor when the voltage associated with the first node exceeds a predetermined threshold.

8. The CMOS process based voltage reference circuit of claim 6, the startup circuit further comprising:

a fifth MOS transistor that shares a common bias with the fourth transistor;

a sixth MOS transistor that is configured to bias and fifth transistors when active;

a seventh MOS transistor that is configured to disable the sixth transistor when active such that the start-up current is disabled;

an eighth MOS transistor that is configured to activate the seventh transistor when the voltage associated with the first node exceeds a predetermined threshold, wherein the fifth transistor is further configured to disable the seventh transistor when the voltage associated with the first node is below the predetermined threshold; and a ninth transistor that is configured to activate the sixth transistor when the error amplifier is in operation.

9. The CMOS process based voltage reference circuit of claim 1, further comprising a bias circuit that is configured to bias the error amplifier with a bias signal that is related to a current reference, wherein the current reference is proportional to absolute temperature such that higher-order temperature effects in the voltage reference circuit are minimized.

10. The CMOS process based voltage reference circuit of claim 1, the bias circuit further comprising:

a fourth bipolar transistor that is configured as a diode, wherein the fourth bipolar transistor is a parasitic transistor in the CMOS process that includes an emitter that is coupled to a fourth emitter node;

a fifth bipolar transistor that is configured as a diode, wherein the fifth bipolar transistor is a parasitic transistor in the CMOS process that includes an emitter that is coupled to a fifth emitter node;

a seventh resistor that is coupled between a first sense node and a common node;

an eighth resistor that is coupled between the first sense node and the fourth emitter node;

a ninth resistor that is coupled to the common node and the fifth emitter node;

an other CMOS amplifier that includes a first input that is coupled to the first sense node, a second input that is coupled to the second sense node, and an output that is arranged to provide the bias signal in response to the voltages associated with the first and second sense nodes; and a third MOS current source that includes an output that is coupled to the common node, and an input that is arranged to receive the bias signal such that a third current is provided to the common node in response to the bias signal.

11. The CMOS process based voltage reference circuit of claim 10, the other CMOS amplifier comprising:

a first MOS transistor that includes a gate that is coupled to the second sense node;

a second MOS transistor that includes a gate that is coupled to the first sense node, wherein the first and second MOS transistors are configured to operate as a differential pair with a common source;

a first current mirror that is coupled to drains of the first and second MOS transistors;

a third MOS transistor that includes a gate that is coupled to the drain of the second MOS transistor, a source that is coupled to a power supply node, and a drain that is coupled to a bias output node;

a fourth MOS current source that is includes an output that is coupled to the common source, and an input that is arranged to receive the bias signal such that a fourth current is provided to the common node in response to the bias signal; and a fifth MOS current source that is includes an output and an input that are coupled to the bias output node, wherein the second CMOS amplifier is arranged to provide the bias signal at the bias output node.

12. The CMOS process based voltage reference circuit of claim 10, wherein the other CMOS amplifier is a self-biased amplifier.

13. The CMOS process based voltage reference circuit of claim 10, the other CMOS amplifier further comprising a startup circuit, wherein the startup circuit includes a first MOS transistor that is configured to provide a start-up current to the common node when active, a second MOS transistor that is configured to bias the first MOS transistor when active, a third MOS transistor that is configured to activate the second MOS transistor when active and disable the second MOS transistor when inactive, wherein the third MOS transistor includes a source that is coupled to the common node.

14. The CMOS process based voltage reference circuit of claim 1, the CMOS amplifier further comprising:

a first MOS transistor that includes a gate that is coupled to the fourth node;

a second MOS transistor that includes a gate that is coupled to the second emitter node, wherein the first and second MOS transistors are configured to operate as a differential pair;

a fourth MOS current source that is coupled to the drain of the first MOS transistor;

a fifth MOS current source that is coupled to the drain of the second MOS transistor;

a first MOS current mirror that is coupled to a first intermediary node and a second intermediary node;

a first MOS cascode transistor that includes a source that is coupled to the drain of the first MOS transistor, and a drain that is coupled to the first intermediary node;

a second MOS cascode transistor that includes a source that is coupled to the drain of the second MOS transistor, and a drain that is coupled to the second intermediary node;

a third MOS transistor that includes a gate that is coupled to second intermediary node, a source that is coupled to a power supply node, and a drain that is coupled to a third intermediary node;

a second MOS current mirror that is coupled to a fourth intermediary node and the control node;

a third MOS cascode transistor that includes a source that is coupled to the third intermediary node, and a drain that is coupled to the fourth intermediary node;

a fourth MOS cascode transistor that is includes a source that is coupled to a fifth intermediary node, and a drain that is coupled to the control node; and a fourth MOS transistor that includes a gate that is coupled to the control node, a source that is coupled to the power supply node, and a drain that is coupled to the fifth intermediary node.

15. The CMOS process based voltage reference circuit of claim 1, wherein the CMOS amplifier is a folded cascode amplifier.

* * * * *

UNITED STATES PATENT AND TRADEMARK OFFICE

CERTIFICATE OF CORRECTION

PATENT NO. : 6,677,808 B1
DATED : January 13, 2004
INVENTOR(S) : Sean S. Chen et al.

It is certified that error appears in the above-identified patent and that said Letters Patent is hereby corrected as shown below:

Title page,
Item [12], "Sean et al." should read -- Chen et al. --
Item [75], Inventors, "S. Chen Sean, Sunnyvale, CA (US); Don R. Sauer, San Jose, CA (US)" should read -- [75] Inventors: Sean S. Chen, Sunnyvale, CA (US); Don R. Sauer, San Jose, CA (US) --

Signed and Sealed this

Twenty-second Day of June, 2004

JON W. DUDAS
*Acting Director of the United States Patent and Trademark Office*